US007980906B2

(12) United States Patent
Ozaki et al.

(10) Patent No.: US 7,980,906 B2
(45) Date of Patent: Jul. 19, 2011

(54) PERSONAL WATERCRAFT

(75) Inventors: Atsufumi Ozaki, Kobe (JP); Yasuo Okada, Akashi (JP); Akio Miguchi, Kobe (JP); Hiroshi Yagii, Akashi (JP); Toshio Araki, Kakogawa (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 85 days.

(21) Appl. No.: 12/345,491

(22) Filed: Dec. 29, 2008

(65) Prior Publication Data

US 2010/0167607 A1 Jul. 1, 2010

(51) Int. Cl.
*F01P 3/20* (2006.01)
*F28F 9/02* (2006.01)
*F28F 9/04* (2006.01)

(52) U.S. Cl. ..... 440/88 HE

(58) Field of Classification Search ..... 440/88 R, 440/88 C, 88 HE

See application file for complete search history.

(56) References Cited

U.S. PATENT DOCUMENTS 7,247,067 B2 * 7/2007 Mashiko ..... 440/88 A
7,455,035 B2 * 11/2008 Sanai ..... 123/41.02
7,536,855 B2 * 5/2009 Tsukahara ..... 60/324

FOREIGN PATENT DOCUMENTS

JP 2004-162669 6/2004
JP 2007-315336 12/2007

* cited by examiner

*Primary Examiner* — Daniel V Venne
(74) *Attorney, Agent, or Firm* — Alleman Hall McCoy Russell & Tuttle LLP

(57) ABSTRACT

A personal watercraft comprises an engine which is mounted in a body of the watercraft and is equipped with an open-loop water cooling system; a coolant passage in which water for cooling the engine flows; a water flow generator configured to operate in association with the engine to generate a water flow in the coolant passage; and a valve unit configured to restrict a flow of the water in the coolant passage.

12 Claims, 11 Drawing Sheets

PERSONAL WATERCRAFT

TECHNICAL FIELD

The present invention relates to a personal watercraft equipped with a water jet pump which is configured to eject a water jet by an engine driving power to generate a propulsion force for propelling a body of the watercraft.

BACKGROUND ART

The personal watercraft includes a cooling system configured to cool an engine and engine oil. As an example of the cooling system, Japanese Laid-Open Patent Application Publication No. 2007-315336 discloses an open-loop water cooling system. In this open-loop water cooling system, water in a sea, a lake or a river, which is around the watercraft, is suctioned by a pump for use as a coolant for cooling the engine and the engine oil. As the pump in this system, a water jet pump is typically used.

Typically, the water ejected from the pump is sent to an exhaust system through an oil cooler, using one of a plurality of systems. In the oil cooler, the water exchanges heat with the engine oil so that the engine oil is controlled to have a suitable temperature. The water in the exhaust system is guided to a passage formed within an engine body. Inside the engine body, the water exchanges heat with a wall surface of the engine so that the engine is controlled to have a suitable temperature. Then, the water is drained from the inside of the engine body outside the watercraft.

The temperature of water suctioned as the coolant varies depending on season, environment, etc. In the winter season, the temperature of the water tends to be lower than in the summer season. In the winter season, after the engine starts, such cold water is sent to the inside of the engine body. For this reason, a relatively long time is required to warm up and efficiently run the engine. In this case, since the temperature of the engine is difficult to increase, the temperature of the engine oil is difficult to increase.

The water ejected from the pump is sent to the oil cooler before being sent to the exhaust system, the interior of the engine body, etc. Such routing makes it difficult to increase the temperature of the engine in the winter season.

In general, engine components are suitably lubricated or sealed by the engine oil having a suitable temperature. In the winter season, however, a relatively long time is required to increase the temperature of the engine oil up to a suitable one.

SUMMARY OF THE INVENTION

The present invention addresses the above described condition, and an object of the present invention is to make it easy to increase the temperature of an engine and the temperature of engine oil, irrespective of season, environments, etc.

According to an aspect of the present invention, there is provided a personal watercraft comprising an engine which is mounted in a body of the watercraft and includes an open-loop water cooling system; a coolant passage in which water for cooling the engine flows; a water flow generator configured to operate in association with the engine to generate a water flow in the coolant passage; and a valve unit configured to restrict a flow of the water in the coolant passage.

In accordance with such a configuration, the flow of the water in the coolant passage is restricted by the valve unit. This makes it easy to increase the temperature of the engine. Since the temperature of the engine easily increases, the temperature of the engine oil easily increases.

According to another aspect of the present invention, there is provided a personal watercraft comprising an engine which is mounted in a body of the watercraft and is equipped with an open-loop water cooling system; a coolant passage in which water for cooling the engine flows; and a water flow generator configured to operate in association with the engine to generate a water flow in the coolant passage. The coolant passage may include an oil cooler passage in which the water exchanges heat with engine oil sent to an oil cooler configured to control a temperature of the engine oil; an inlet passage coupled to an inlet port of the oil cooler passage; an outlet passage coupled to an outlet port of the oil cooler passage; and a bypass passage configured to directly couple the inlet passage to the outlet passage.

In accordance with such a configuration, since a part of the water flowing in the inlet passage is directly sent to the outlet passage via the bypass passage, the amount of water sent to the oil cooler passage is restricted. As a result, even in the winter season, the temperature of the engine oil easily increases.

According to a further aspect of the present invention, there is provided a personal watercraft comprising an engine which is mounted in a body of the watercraft and is equipped with an open-loop water cooling system; a coolant passage in which water for cooling the engine flows; and a water flow generator configured to operate in association with the engine to generate a water flow in the coolant passage. The coolant passage includes an upstream passage located upstream of the engine in a water flow direction and a downstream passage located downstream of the engine. The downstream passage is coupled to an oil cooler passage in which the water exchanges heat with engine oil sent to an oil cooler configured to control a temperature of engine oil.

In accordance with such a configuration, since the water sent to the oil cooler passage is made warm by the heat exchange with the engine, the temperature of the engine oil easily increases in the winter season.

The above and further objects and features of the invention will more fully be apparent from the following detailed description with accompanying drawings.

DETAILED DESCRIPTION OF THE PREFERRED EMBODIMENTS

Hereinafter, embodiments of the present invention will be described with reference to the accompanying drawings. Hereinbelow, the directions are referenced from a rider (not shown) riding in a personal watercraft except for cases specifically illustrated.

Embodiment 1

Figure 1:
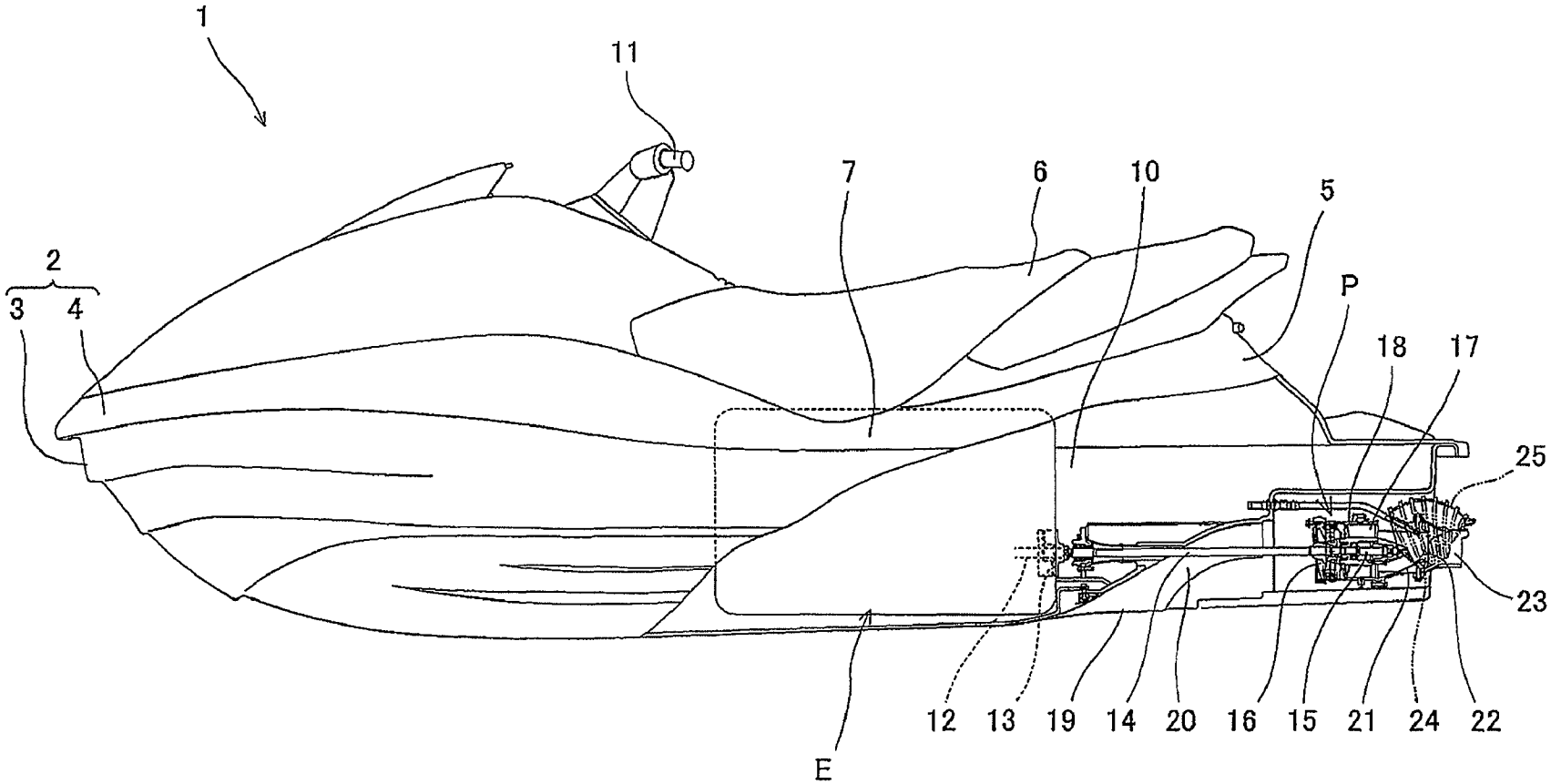
FIG. 1 is a partial cross-sectional view of a personal watercraft according to an embodiment of the present invention, as viewed from the left.

FIG. 1 is a partial cross-sectional view of a personal watercraft 1 according to the embodiment of the present invention, as viewed from the left. Turning now to FIG. 1, the personal watercraft 1 is a straddle-type jet-propulsion personal watercraft which is provided with a seat 6 straddled by the rider. A body 2 of the watercraft 1 includes a hull 3 and a deck 4 covering the hull 3 from above. A center section in a width direction protrudes upward at a rear part of the deck 4 to form a protruding portion 5. The seat 6 is mounted over an upper surface of the protruding portion 5. A deck floor 7 is formed at both sides in the width direction of the protruding portion 5 to be substantially flat and lower than the protruding portion 5 to enable the rider to put feet thereon.

A space defined by the hull 3 and the deck 4 below the seat 6 is an engine room 10 in which an engine E is mounted. A crankshaft 12 of the engine E extends along the longitudinal direction of the body 2. An output end portion of the crankshaft 12 is coupled to a propeller shaft 14 via a coupling device 13. The propeller shaft 14 is coupled to a pump shaft 15 of a water jet pump P disposed at a rear portion of the body 2. The pump shaft 15 rotates in association with the rotation of the crankshaft 12. An impeller 16 is attached on the pump shaft 15 of the water jet pump P. Fairing vanes 17 are disposed behind the impeller 16. The impeller 16 is covered with a tubular pump casing 18 on the outer periphery thereof.

A water intake 19 is provided on a bottom surface of the hull 3 of the body 2. The water intake 19 is connected to the pump casing 18 through a water passage 20. A pump nozzle 21 is provided at a rear portion of the body 2 and is coupled to the pump casing 18. The pump nozzle 21 has a diameter decreasing rearward, and an outlet port 22 opens at a rear end thereof. A steering nozzle 23 is coupled to the outlet port 22 of the pump nozzle 21 such that the steering nozzle 23 is pivotable to the right or to the left.

Water outside the watercraft 1 is sucked from the water intake 19 on the bottom surface of the hull 3 and is fed to the water jet pump P through the water passage 20. Driven by the engine E, the water jet pump P causes the impeller 16 to rotate to pressurize and accelerate the water. The water is guided by the fairing vanes 17 and ejected rearward from the outlet port 22 of the pump nozzle 21 and through the steering nozzle 23. As the resulting reaction, the watercraft 1 obtains a propulsion force for propelling the body 2. A bowl-shaped reverse deflector 25 is mounted at an upper portion of the steering nozzle 23 to be pivotable around a pivot shaft 24 oriented substantially horizontally.

A steering handle 11 is disposed in front of the seat 6. A throttle lever (not shown) is attached to a right grip of the handle 11 and is configured to be operated with a right hand of the rider. The handle 11 is coupled to the steering nozzle 23 via a steering cable (not shown). When the rider rotates the steering handle 11 clockwise or counterclockwise, the steering nozzle 23 is pivotable to the right or to the left, changing the direction of the water ejected from the steering nozzle 23 to the left or to the right. Correspondingly, the moving direction of the watercraft 1 can be changed.

Figure 2:
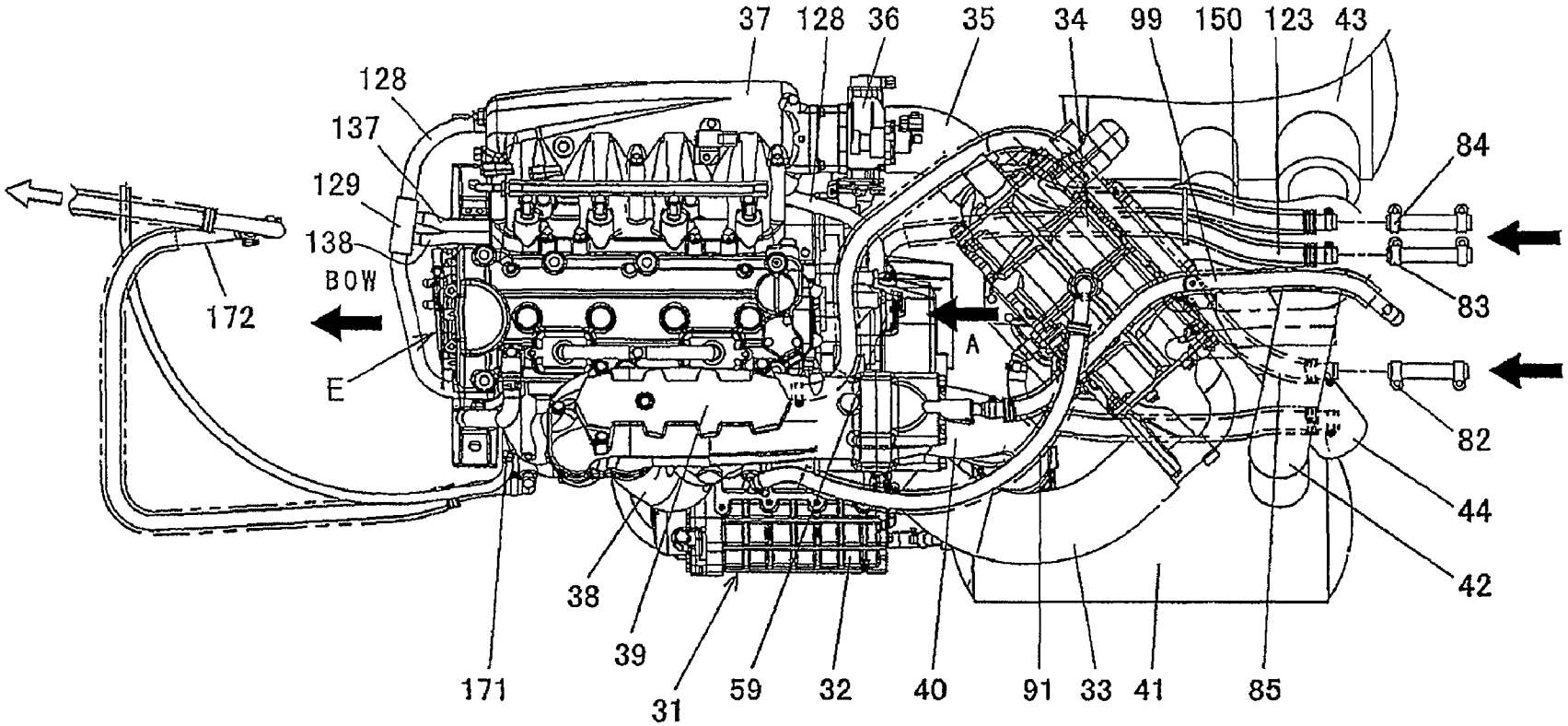
FIG. 2 is a plan view showing a region surrounding an engine mounted in the personal watercraft of FIG. 1.

FIG. 2 is a plan view showing a region surrounding the engine E mounted in the personal watercraft of FIG. 1. With reference to FIG. 2, an air-intake system and an exhaust system of the engine E will be described. The engine E is an inline four-cylinder four-cycle engine and is disposed such that cylinders 52 (see FIG. 3) are arranged in the longitudinal direction of the body 2.

The engine E is attached with a supercharger 31. A housing 32 of the supercharger 31 is attached on a left side surface of an engine body of the engine E. An air box (not shown) is coupled to the housing 32 of the supercharger 31 via a first air-intake pipe (not shown). In this structure, the air is taken into the housing 32 via the air box and the first air-intake pipe. Inside the housing 32 of the supercharger 31, a pump (not shown) is mounted and is configured to operate according to a rotational driving force of the crankshaft 12 (see FIG. 1). During running of the engine E, the air taken into the housing 32 is compressed by the pump. The compressed high-pressure and high-temperature air is sent to an intercooler 34 via a second air-intake pipe 33 which is coupled to the housing 32 so as to extend rearward.

The intercooler 34 is a box-like device for cooling the air sent from the supercharger 31. The intercooler 34 is disposed behind the engine body of the engine E. The high-pressure air which has been cooled in the intercooler 34 is sent to the interior of a throttle body 36 via a third air-intake pipe 35 coupled to the intercooler 34.

The throttle body 36 is coupled to an air inlet of an intake manifold 37. In the interior of the throttle body 36, a throttle valve (not shown) is provided to operate in association with the operation of the throttle lever. The throttle valve operates according to the amount of the operation of the throttle lever, changing a passage cross-sectional area of the interior of the throttle body 36. Thus, the amount of air sent from the intercooler 34 to the intake manifold 37 is controlled. The intake manifold 37 extends in the longitudinal direction of the body 2 through an upper portion on a right side of the engine E, and distributes the air sent from the throttle body 36 to the intake ports (not shown) of the engine E which respectively correspond to the cylinders 52 (see FIG. 3). Then, the air is sent from the intake ports to combustion chambers (not shown) of the engine E which respectively correspond to the cylinders 52 (see FIG. 3).

In the interior of each combustion chamber, the air is mixed with a fuel injected from a fuel injector (not shown) to generate an air-fuel mixture. The air-fuel mixture is combusted by an operation of an ignition plug (not shown) in the interior of the combustion chamber.

Figure 3:
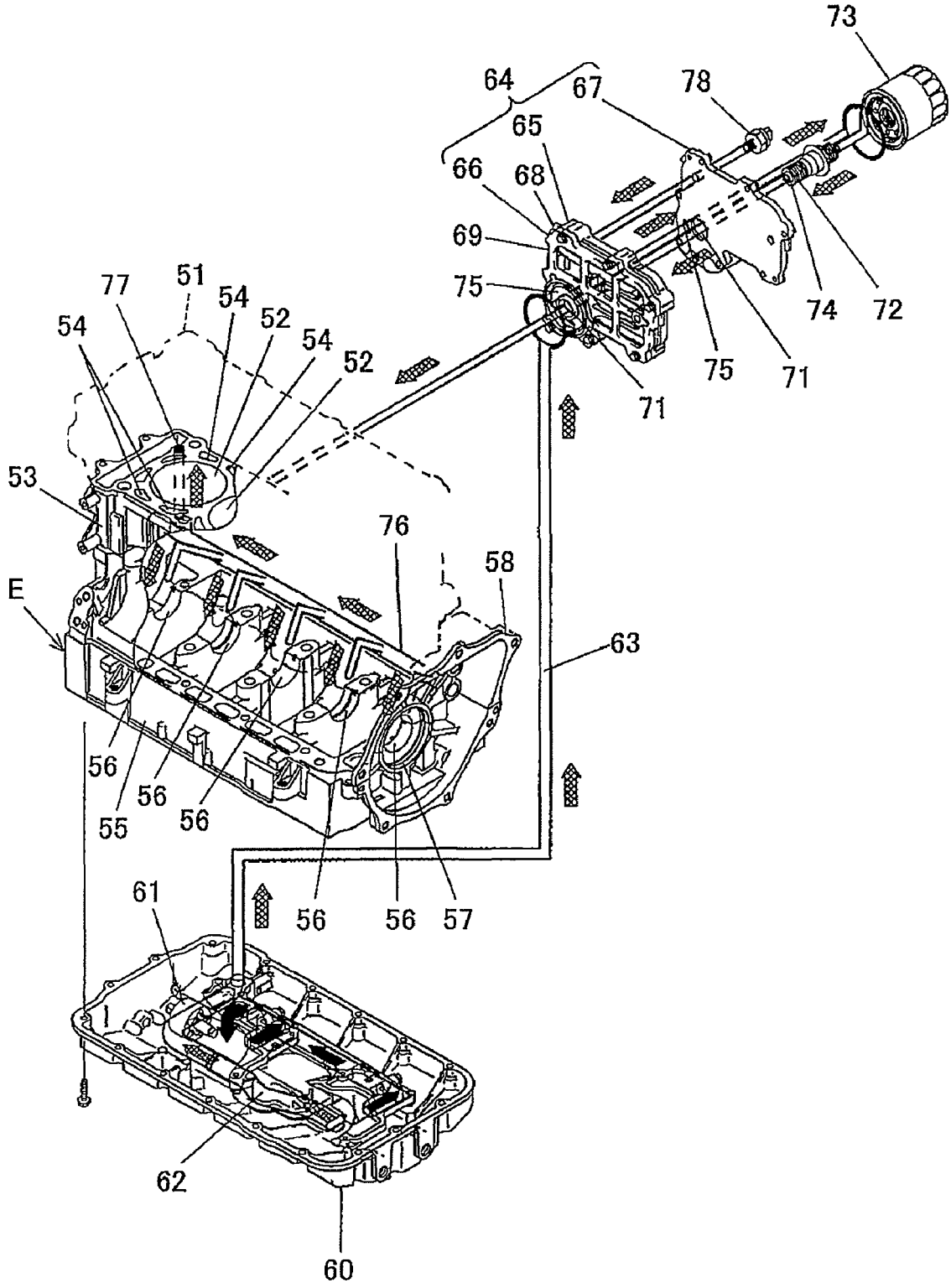
FIG. 3 is a view showing a flow of engine oil of the engine of FIG. 2.

A gas generated by combustion, i.e., an exhaust gas, flows to exhaust manifolds 38 via exhaust ports (not shown) of the engine E which respectively correspond to the cylinders 52 (see FIG. 3). The exhaust ports are arranged on a left side surface of the engine E in the longitudinal direction of the body 2. A plurality of air inlets are provided at one end side of the exhaust manifolds 38 and are respectively coupled to the associated exhaust ports. The exhaust gas flows into the exhaust manifolds 38 via the air inlets and to an exhaust pipe 39 coupled to opposite ends of the exhaust manifolds 38. The exhaust gas sent from the exhaust manifolds 38 merges at the exhaust pipe 39.

The exhaust pipe 39 extends in the longitudinal direction above the left side of the engine body of the engine E. A part of the exhaust pipe 39 protrudes rearward farther than the rear surface of the engine E. A muffler body 40 is coupled to a rear end of the exhaust pipe 39.

The muffler body 40 extends downward and is coupled to a left water muffler 41 disposed behind the left side of the engine body of the engine E.

The left water muffler 41 is coupled to a right water muffler 43 which is disposed behind the right side of the engine E. The right water muffler 43 is coupled to a second muffler pipe 44 extending to outside the watercraft.

In the above configured exhaust system, the exhaust gas in the exhaust manifolds 38 is discharged outside the watercraft, via the exhaust pipe 39, the muffler body 40, the left water muffler 41, the first muffler pipe 42, the right water muffler 43, and the second muffler pipe 44.

FIG. 3 is a view showing a flow of the engine oil of the engine E shown in FIG. 2, in which the engine body is illustrated as being partially cut away and partially exploded. With reference to FIG. 3, a structure of the engine body of the engine E and a lubricating system therefor will be described. The engine body of the engine E has a cylinder head 51 provided with the intake and exhaust ports and the combustion chambers (not shown). A cylinder block 53 provided with the cylinders 52 is coupled to a lower side of the cylinder head 51. In FIG. 3, only two cylinders 52 which are located on front side are illustrated, but actually, four cylinders are arranged in the cylinder block 53 in the longitudinal direction of the body 2. A piston (not shown) is inserted into each cylinder 52.

Cylinder block passages 54 are formed in the cylinder block 53 to extend around each cylinder 52. A coolant, i.e., cooling water, flows in the cylinder block passages 54. Although not shown in detail, cylinder head passages 87 (see FIG. 4) are formed in the cylinder head 51 to extend around the air-intake ports and the combustion chambers. The coolant flows in the cylinder head passages 87. The cylinder block passages 54 open on an upper surface of the cylinder block 53 and are respectively connected to the cylinder head passages 87 via the openings. The openings of the respective cylinder block passages 54 are arranged to be spaced apart from each other in the circumferential direction of the cylinder 52.

A crankcase 55 is coupled to a lower side of the cylinder block 53 to rotatably support the crankshaft 12 (see FIG. 1). The crankcase 55 includes upper and lower half bodies which are jointed to each other. As shown in FIG. 3, the lower half body 56 of a bearing hole for supporting a journal of the crankshaft 12 (see FIG. 1) is formed at the lower half body 56 of the crankcase 55. The crankcase 55 is provided with a hole 57 on a rear surface thereof so that a rear end portion of the crankshaft 12 protrudes therefrom. A circumferential rib 58 protrudes from the rear surface of the crankcase 55 to surround an outer side of the hole 57. A cup-shaped generator cover 59 (see FIG. 5) is attached to a rear end surface of the rib 58. An AC generator (not shown) is accommodated inside the generator cover 59 to generate an AC electric power by the rotational driving force of the crankshaft 12.

An oil pan 60 is coupled to a lower side of the crankcase 55 and is configured to store the engine oil. An oil pump 61 is accommodated within the oil pan 60 and is configured to operate based on the rotational force of the crankshaft 12. The oil pump 61 suctions the engine oil which has passed through the oil separator 62 inside the oil pan 60, and ejects the suctioned engine oil to an oil passage 63. The oil passage 63 is coupled to an oil cooler 64.

The oil cooler 64 is formed by covering both sides of an oil cooler body 65 with a pair of oil cooler cases 66 and 67. An oil cooler passage 140 (see FIG. 5) is provided in the interior of the oil cooler 64 to allow the coolant to flow therethrough. The oil cooler body 65 is provided with an inlet port 68 and an outlet port 69 of the oil cooler passage 140.

The oil cooler 64 is provided with a hole 71 penetrating through the oil cooler body 65 and the oil cooler cases 66 and 67 in a direction in which the oil cooler body 65 and the oil cooler cases 66 and 67 are arranged. An oil passage bolt 72 is inserted into the hole 71 so that the oil cooler 64 is fastened to a right side surface of the engine body of the engine E by one end portion of the oil passage bolt 72. An oil filter 73 is fastened to a right side surface of the oil cooler 64 by an opposite end portion of the oil passage bolt 72. The oil passage bolt 72 has a penetrating hole 74 extending in an axial direction thereof. The oil cooler 64 is provided with an oil passage 75 on an outer peripheral side of the hole 71.

The engine oil is sent from the oil passage 63 to the oil cooler 64. In the oil cooler 64, the engine oil is sent to the oil passage 75. Through the oil passage 75, the engine oil is guided to the oil filter 73 which filters the engine oil. Then, the engine oil which has been filtered by the oil filter 73, is sent to the penetrating hole 74 of the oil passage bolt 72. Then, the engine oil is sent from the right side surface of the engine body of the engine E to the interior of the engine body. Thus, the engine oil exchanges heat with the coolant flowing in the oil cooler passage 140 while flowing back and forth in the oil cooler 64 so that the engine oil is controlled to have a suitable temperature.

A main oil passage 76 is provided in the interior of the engine body of the engine E. The engine oil is sent to the main oil passage 76 and then to an oil pipe 77 extending vertically in the interior of the cylinder block 53, the bearing hole 56 of the crankcase 55, and others. The engine oil sent to the components of the engine E serves to lubricate a journal of the crankshaft 12 (see FIG. 1) or the piston, and to seal a clearance formed between the piston and the inner peripheral surface of the cylinder 52.

After the engine oil is sent to the components of the engine E, the engine oil is returned to the oil pan 60 through, for example, a return pipe (not shown). The engine oil in the bearing hole 56 flows into the crankcase 55 and directly drops to the oil pan 60. A switch 78 shown in FIG. 3 serves to detect an oil pressure in the interior of the oil cooler 64. The above described configuration is identical in the first and second embodiments.

Figure 4:
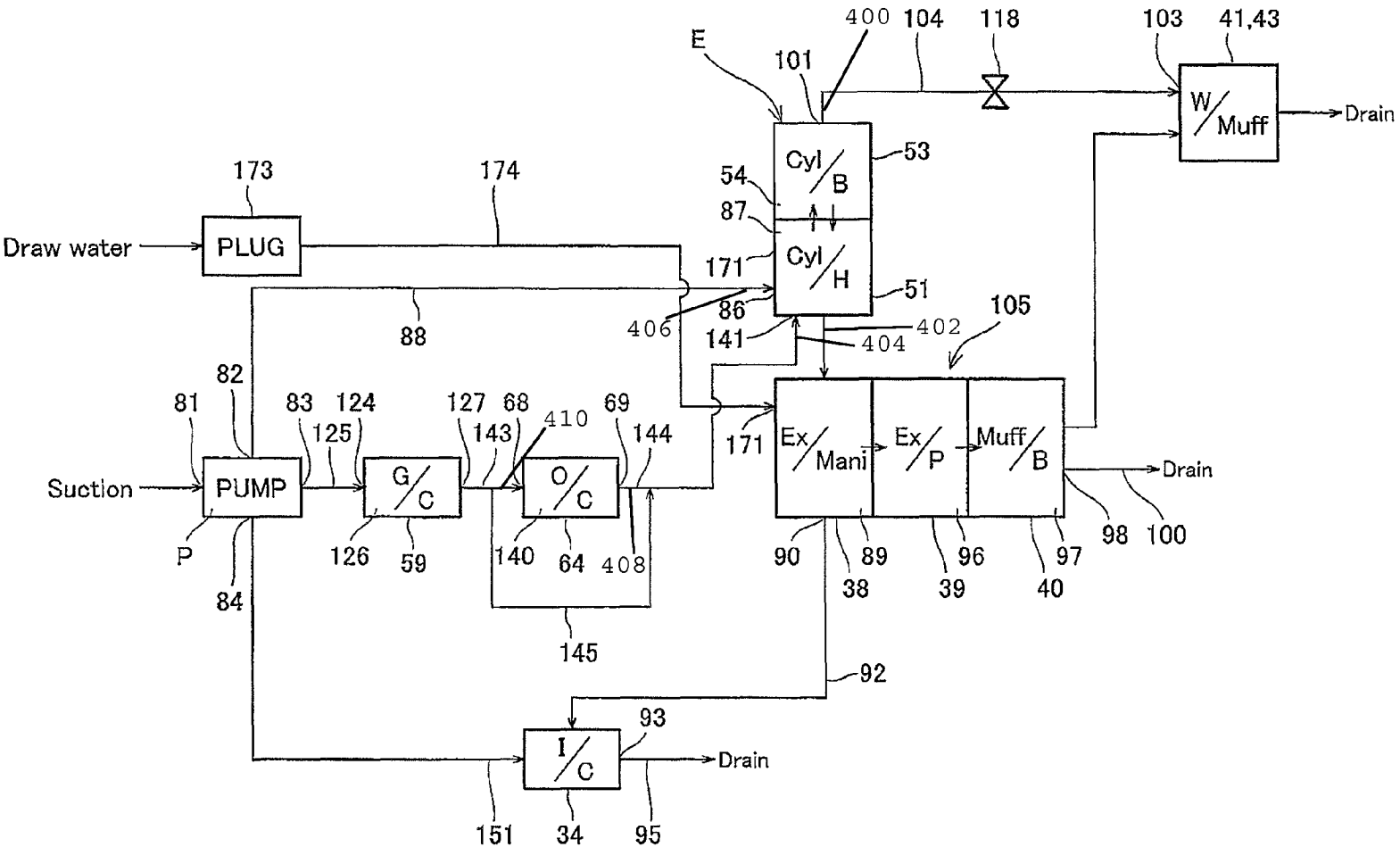
FIG. 4 is a block diagram schematically showing a cooling system according to a first embodiment which is applied to the personal watercraft of FIG. 1.
Figure 5:
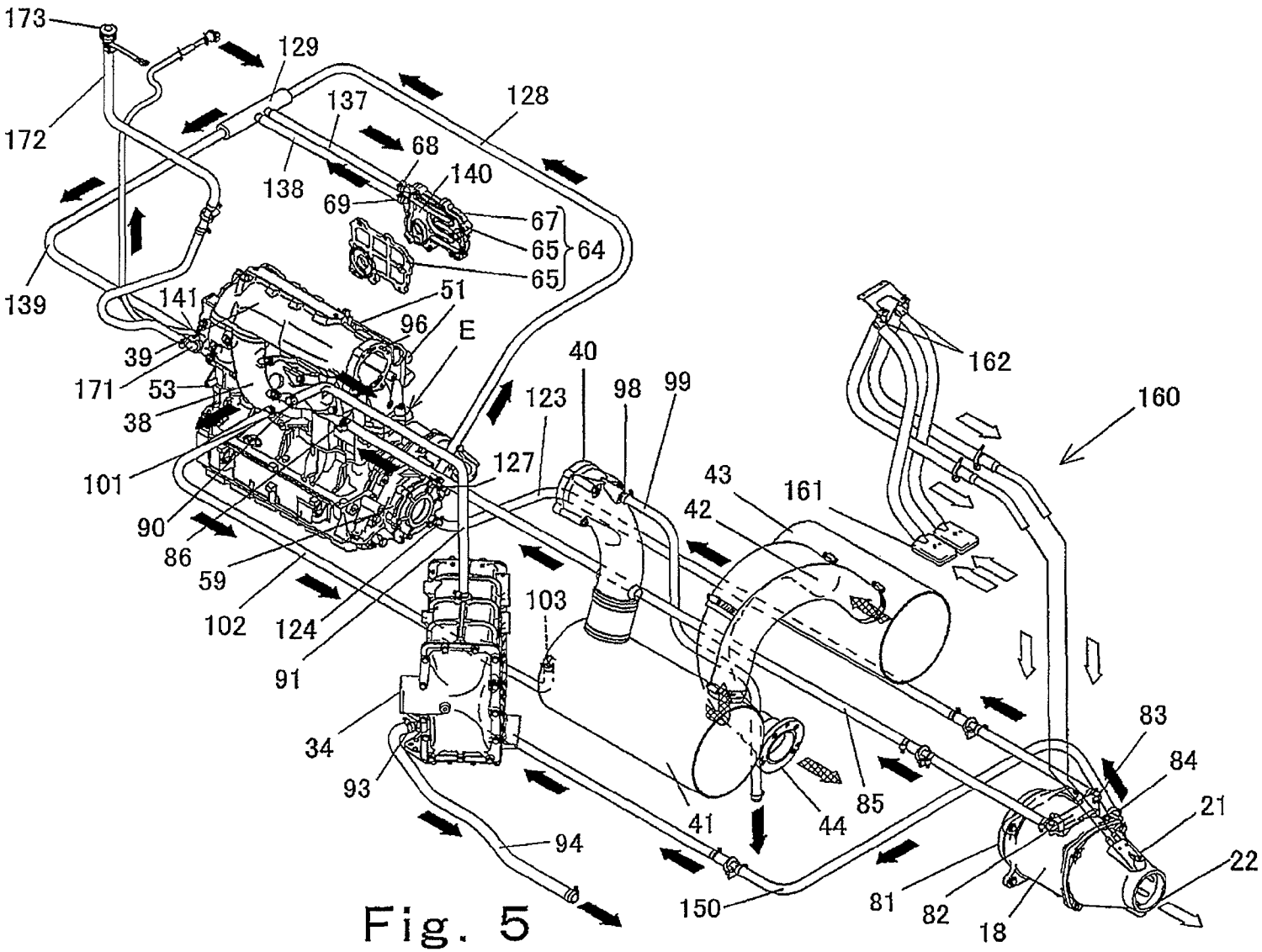
FIG. 5 is a view showing a structure of the cooling system of FIG. 4.

FIG. 4 is a block diagram schematically showing a cooling system of the first embodiment which is applicable to the personal watercraft of FIG. 1. FIG. 5 is a view showing a detailed structure of the cooling system of FIG. 4. With reference to FIGS. 4 and 5, the cooling system of the first embodiment will be described. The cooling system applied to the watercraft 1 is an open-loop water cooling system. In the open-loop water cooling system, the water jet pump P which operates in association with the engine E suctions the water from outside the watercraft for use as the coolant. The water jet pump P guides a part of the suctioned water to the coolant passage to cool the engine E, the oil passage 64, and other components. The water jet pump P serves as a water flow generator which generates a water flow within the coolant passage. The water in the coolant passage is drained outside the watercraft.

To be specific, the pump casing 18 of the pump P is provided with an inlet port 81 coupled to the water intake passage 20 (see FIG. 1). The pump casing 18 is provided with three water drawing ports 82, 83, and 84 on the outer peripheral surface thereof. The water drawing ports 82, 83, and 84 are positioned rearward with respect to the impeller 16 (see FIG.

1) which is a water generating device for generating a water jet to generate the water flow, i.e., downstream of the impeller 16 in a water flow direction.

The first water drawing port 82 is coupled to a water inlet 86 of the cylinder head 51 via an engine water supply hose 85. In this structure, the water ejected from the pump P flows through the engine water supply hose 85 to the cylinder head passage 87 formed within the cylinder head 51. The cylinder head passages 87 are connected to the cylinder block passages 54. The passages 87 and 54 form integral passages within the engine E, while the passage within the engine water supply hose 85 forms an upstream passage 88 through which the water flows into the passage of the engine E flows. 406 is a downstream end of the upstream passage 88.

The cylinder head passage 87 is connected to a manifold passage 89 formed within the exhaust manifold 38.

The exhaust manifold 38 is provided with a water outlet 90 on an outer surface thereof. The water flowing in the manifold passage 89 is sent to the intercooler 34 via a passage 92 within an intercooler water supply hose 91 coupled to the water outlet 90. In the intercooler 34, the water exchanges heat with the air sent from the supercharger 31 (see FIG. 1) to cool the air to be supplied to the throttle body 36 (see FIG. 2). The intercooler 34 is provided with a water outlet 93 on an outer surface thereof. A drain hose 94 is coupled to the water outlet 93. In this structure, the water is drained from the intercooler 34 to outside the watercraft via a passage 95 formed within the drain hose 94.

The manifold passage 89 is coupled to an exhaust pipe passage 96 formed in the exhaust pipe 39. The exhaust pipe passage 96 is connected to a muffler body passage 97 formed within the muffler body 40. While flowing in the exhaust manifold passage 89, the exhaust pipe passage 96 and the muffler body passage 97, the water exchanges heat with the exhaust manifold 38, the exhaust pipe 39 and the muffler body 40, to cool these components forming an exhaust system.

The muffler body 40 is provided with a water outlet 98 on an outer surface thereof. A drain hose 99 is coupled to the water outlet 98. In this structure, the water is drained from the muffler body 40 outside the watercraft via a passage 100 formed within the drain hose 99. Also, the water is sent from the muffler body 40 to the left water muffler 41. Then, the water is drained from the left water muffler 41 outside the watercraft together with the exhaust gas flowing into the left water muffler 41 via the muffler body 40.

The cylinder block 53 is provided with a water outlet 101 on a left side surface thereof. One end of a muffler water supply hose 102 (see FIG. 5) is coupled to the water outlet 101. An opposite end of the muffler water supply hose 102 is coupled to the water inlet 103 of the left water muffler 41.

As described above, the manifold passage 89 connected to the cylinder head passage 87 and a passage located downstream thereof form a downstream passage 105 to which the water from the passage within the engine E flows out, while the passage within the muffler water supply hose 102 which is connected to the cylinder block passage 54 forms a downstream passage 104 to which the water from the passage within the engine E flows out. In brief, the cooling system includes the two downstream passages 104 and 105. 400 is an upstream end of the downstream passage 104, and 402 is an upstream end of the downstream passage 105.

Figure 6:
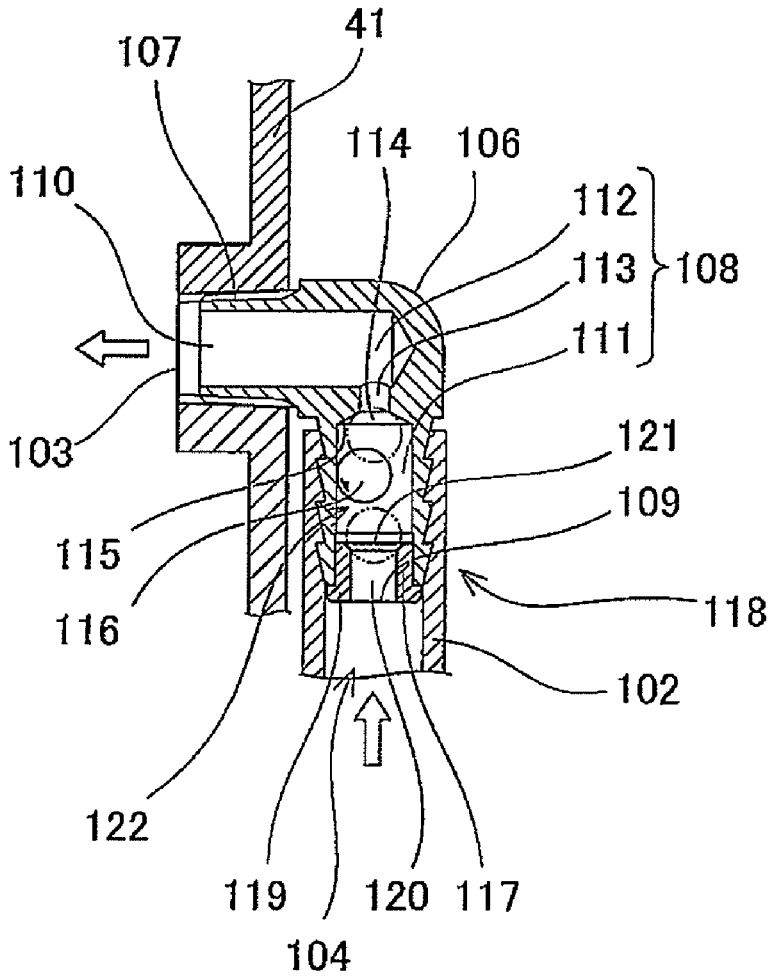
FIG. 6 is a partial cross-sectional view showing a structure of a valve unit of FIG. 4.

FIG. 6 shows a structure for coupling the muffler water supply hose 102 to the left water muffler 41. One end portion of an elbow pipe 106 having a L-shaped cross-section is threadedly engaged with the water inlet 103 of the left water muffler 41. A male thread 107 is formed on the outer peripheral surface of one end portion of the elbow pipe 106 and is threadedly engaged with the water inlet 103. An opposite end portion of the elbow pipe 106 extends downward at a right angle with respect to the direction in which the one end portion thereof extends. An opposite end of the muffler water supply hose 102 is fitted with a pressure to the outer peripheral surface of the opposite end portion of the elbow pipe 106. The elbow pipe 106 has inside thereof a passage 108 through which the water sent from the muffler water supply hose 102 is guided to the left water muffler 41. An inlet port 109 of the passage 108 is formed at an opposite end of the elbow pipe 106, and an outlet port 110 thereof is formed at one end of the elbow pipe 106.

The passage 108 has an inlet portion 111 having a circular cross-section, extending through the inside of the opposite end portion of the elbow pipe 106, an outlet portion 112 having a circular cross-section, extending through the inside of the one end portion of the elbow pipe 106, and a connecting portion 113 connecting the inlet portion 111 and the outlet portion 112 to each other. The connecting portion 113 has a diameter smaller than that of the inlet portion 111. Between the inlet portion 111 and the connecting portion 113, a transition portion 114 having a diameter which decreases toward the connecting portion 113 is formed. A conical taper surface 115 is formed inside the elbow pipe 106 so as to form the transition portion 114.

A spherical valve plug 116 is accommodated in the inlet portion 111 of the elbow pipe 106. After the valve plug 116 is accommodated into the inlet portion 111, a collar 117 is fitted with a pressure into the inlet port 109 of the elbow pipe 106. The elbow pipe 106, the valve plug 116, and the collar 117 form a valve unit 118 which substantially opens and closes the downstream passage 104.

To be specific, the collar 117 is of a substantially cylindrical shape. A flange portion 119 is provided at one end portion of the collar 117 so as to extend radially outward. The flange portion 119 is in contact with an end surface of the elbow pipe 106 which defines the inlet port 109. The collar 117 is provided with a penetrating hole 120 extending in an axial direction thereof. The passage within the muffler water supply hose 102 is connected to the passage 108 within the elbow pipe 106 via the penetrating hole 120.

The collar 117 has an outer diameter which is substantially equal to that of the inlet portion 111 to allow the collar 117 to be fitted with a pressure into the inlet portion 111. The penetrating hole 120 has a diameter smaller than that of the inlet portion 111. The valve plug 116 has a diameter which is smaller than that of the inlet portion 111 and is larger than those of the connecting portion 113 and the penetrating hole 120. For this reason, as indicated by two-dotted line, the valve plug 116 is supported on an opening edge 121 of the penetrating hole 120 of the collar 117, and is supported by the taper surface 115 of the transition portion 114.

Thus, in the passage 108 within the elbow pipe 106 forming the downstream passage 104, a valve bore 122 in which the valve plug 116 is accommodated is formed between the connecting portion 113 and the opposite end of the penetrating hole 120. The taper surface 115 of the transition portion 114 forms a downstream seat portion on which the valve plug 116 is seated on a downstream side of the valve bore 122, while the opening edge 121 of the penetrating hole 120 forms an upstream seat portion on which the valve plug 116 is seated on an upstream side of the valve bore 122.

Figure 7:
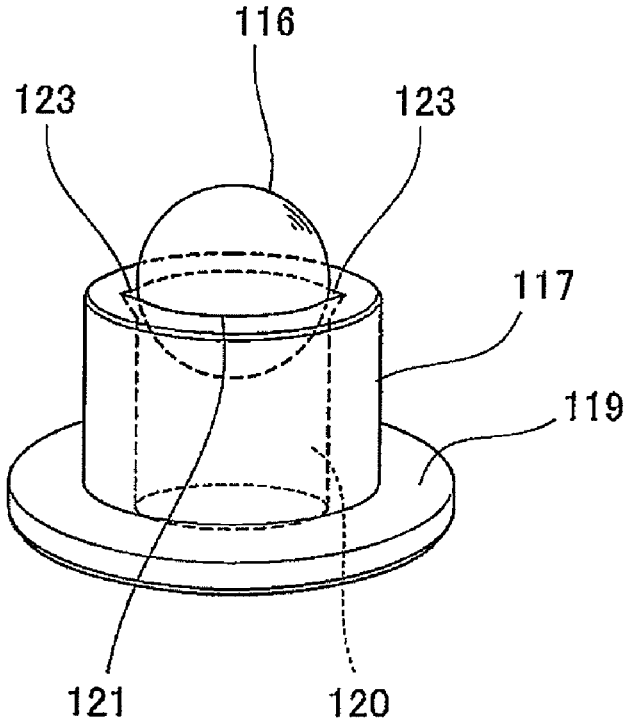
FIG. 7 is a perspective view showing a state where a valve plug of the valve unit of FIG. 6 is seated.

FIG. 7 shows a state where the valve plug 116 is supported on the opening edge 121. Cut portions 123 are formed at an opposite end portion of the collar 117 so as to extend radially outward from the opening edge 121 of the penetrating hole 120. In the illustrated example, two cut portions 123 are formed in opposite positions. With the valve plug 116 supported on the opening edge 121 of the penetrating hole 120, the penetrating hole 120 is connected to the valve bore 122 (see FIG. 6) via the cut portions 123.

The cut portions 123 are not limited to the above described configuration but may have other suitable configuration so long as the penetrating hole 120 is connected to the valve bore 122 with the valve plug 116 supported on the opening edge 121.

Turning to FIG. 6 again, the valve plug 116 drops by its own weight and is supported by the opening edge 121, while the engine E is not running. In this case, the passage 108 is opened. On the other hand, while the engine E is running and the pump P is operating, a water pressure according to an ejecting pressure of the pump P is applied to the water flowing in the passage within the muffler water supply hose 102. The valve plug 116 moves upward inside the valve bore 122 according to the water pressure and the amount of water and is seated on the taper surface 115 of the transition portion 114. In this case, the connecting portion 113 is closed with respect to the inlet portion 111. The valve plug 116 rolls on the taper surface 115 when moving upward, surely closing the end portion of the connecting portion 113 which is located closer to the center.

Thus, while the engine E is running, the passage 108 is closed. So, the water sent to the cylinder block passage 54 is not drained outside the watercraft via the water muffler 41. Therefore, as shown in FIGS. 3 and 4, the water sent from the cylinder head passage 87 to the cylinder block passage 54 returns to the cylinder head passage 87.

The valve unit 118 substantially opens and closes the downstream passage 104 connected to the cylinder block passage 54. The upstream passage 88 in an open state is connected at its downstream end 406 to the cylinder head passage 87, and the downstream passage 105 is connected at its upstream end 402 to the cylinder head passage 87. The cylinder block passage 54 and the cylinder head passage 87 are connected to each other. Such a structure facilitates convection between the water with a relatively high temperature inside the cylinder block passage 54 and the water with a relatively low temperature inside the cylinder head passage 87 in the passage within the engine E. In addition, since the valve unit 118 is provided in the downstream passage 104 instead of the upstream passage 88, the water to be sent to the downstream passage 105 which is not provided with the valve unit 118 does not become extremely small in amount. Thereby, the water flowing in the downstream passage 105 sufficiently cools the components other than the engine E, e.g., components forming the exhaust system in the present embodiment. Furthermore, since the water with an appropriate amount flows from the upstream passage 88 into the passage within the engine E and to the downstream passage 105, the components forming the exhaust system is suitably cooled.

As should be appreciated from the above, in this cooling system, the passage connected to the cylinder block passage 54 is closed by the valve unit 118 and the water convects in the passage within the engine E, the cold water which is sent from the water jet pump P to the interior of the engine E is less in amount. For this reason, even in winter season, the temperature of the engine E easily increases.

Turning to FIGS. 4 and 5 again, a water inlet 171 is provided at a front portion of the exhaust manifold 38 and one end of a flushing hose 172 is coupled to the water inlet 171. A plug 173 is attached to an opposite end of the flushing hose 172. An external hose (not shown) is removably attachable to the plug 173.

In maintenance, the user of the watercraft beaches the watercraft, and couples to the plug 173 the external hose (not shown) connected to a water tap so that tap water flows to the passage 174 within the flushing hose 172 through the plug 174. Thus, the water is sent to the exhaust manifold passage 89 via the exhaust passage 174. Then, the water is sent from the exhaust manifold passage 89 to the penetrating hole 120 of FIG. 6 via the cylinder head passage 87, the cylinder block passage 54, and the passage within the muffler water supply hose 102.

Turning to FIG. 6, the valve plug 116 has a predetermined weight so that the valve plug 116 is unable to move inside the valve bore 122 depending on the flow rate of the tap water. So, the valve plug 116 is seated on the opening edge 121 by its own weight. Therefore, the water sent to the penetrating hole 120 is discharged outside the watercraft via the cut portions 123, the passage 108, the left water muffler 41, the first muffler pipe 42, the right water muffler 43, and the second muffler pipe 44. In this state, the water remaining in the passage within the engine E can be drained, and thus maintenance of the engine E is carried out.

As described above, the valve unit 118 is configured to substantially open and close the passage 108 according to the difference between the gravitational force applied to the valve plug 116 and the force applied to the valve plug 116 based on the flow rate of the water. Since a device for applying a force to cause the valve plug 116 to be seated on the seating portion is not provided, the valve unit 118 is small-sized and lightweight. Such a structure is achieved by disposing the upstream seat portion vertically downward with respect to the downstream seat portion. If it is difficult to form such a configuration, a biasing member such as a spring for applying a force to the valve plug 116 may be mounted within the valve bore 122. As a matter of course, the biasing member may be used even in the configuration in which the upstream seat portion is disposed vertically downward with respect to the downstream portion.

Whereas the valve unit 118 which substantially opens and closes the passage 108 is illustrated in the present embodiment, the valve unit of the present invention is not limited to this structure, so long as the valve unit is capable of limiting the amount of water flowing in the passage during running of the engine E.

The second water drawing port 83 is coupled to the water inlet 124 provided on the outer surface of the generator cover 59 via a generator water supply hose 123. Thereby, the water ejected from the pump P flows in a passage 125 within the generator water supply hose 123, and is sent to a generator cover passage 126 formed in the interior of the generator cover 59. In the generator cover passage 126, the water exchanges heat with the AC generator (not shown) accommodated inside the generator cover 59 so that the AC generator is controlled to have a suitable temperature.

The generator cover 59 is provided with a water outlet 127 on an outer surface thereof. One end of an oil cooler water supply hose 128 is coupled to the water outlet 127. An opposite end of the oil cooler water supply hose 128 is coupled to a fitting member 129.

Figure 8:
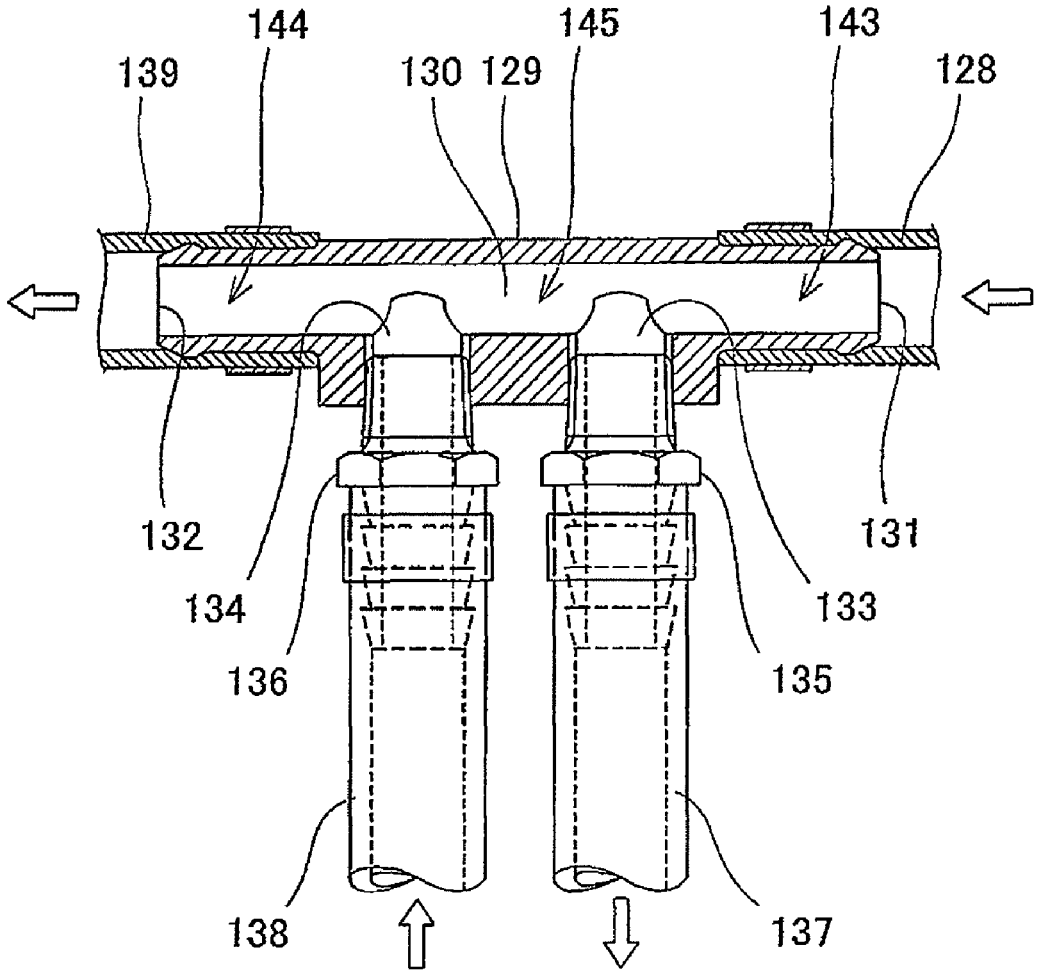
FIG. 8 is a partial cross-sectional view showing a structure of a bypass passage of FIG. 4.

FIG. 8 shows a detailed structure of a region surrounding the fitting member 129. With reference to FIG. 8, the fitting member 129 is substantially cylindrical and has a passage 130 extending axially inside thereof. The fitting member 129 has an inlet port 131 of the passage 130 at axial one end thereof, and an outlet port 132 of the passage 130 at axial opposite end portion thereof. The fitting member 129 has at axial intermediate portion thereof two ports 133 and 134 connected to the passage 130. The ports 133 and 134 extend radially and open on an outer peripheral surface of the fitting member 129. First and second joint members 135 and 136 are externally mounted to the fitting member 129 to couple hoses to the ports 133 and 134, respectively.

An opposite end of the oil cooler water supply hose 128 is fitted with a pressure to the outer peripheral side of the inlet port 131. One end of an oil cooler inlet hose 137 is coupled to the first joint member 135, while one end of an oil cooler outlet hose 138 is coupled to the second joint member 136. One end of an oil cooler water discharge hose 139 is fitted with a pressure to the outer peripheral side of the outlet port 132.

Tuning to FIG. 5 again, an opposite end of the oil cooler inlet hose 137 is coupled to the inlet port 68 of the oil cooler passage 140 formed in the interior of the oil cooler 64. An opposite end of the oil cooler outlet hose 138 is coupled to the outlet port 69 of the oil cooler passage 140. An opposite end of the oil cooler water discharge hose 139 is coupled to a water inlet 141 provided on the outer surface of the cylinder head 51.

With reference to FIGS. 5 and 8, the water flows out from the water outlet 127 of the generator cover 59 and then is sent to the passage 130 within the fitting member 129 through the passage within the oil cooler water supply hose 128. Within the passage 130, the water is directed to flow the direction in which the passage 130 extends so that a large amount water easily flows toward the outlet port 132.

A part of the water within the passage 130 is sent to the oil cooler passage 140 via the port 133 and the passage within the oil cooler inlet hose 137. The oil cooler passage 140 has a labyrinth structure. The water exchanges heat with the engine oil while flowing within the oil cooler passage 140 and is thereafter sent to the passage within the oil cooler outlet hose 138. The water is returned from the passage within the oil cooler outlet hose 138 to the passage 130 within the fitting member 129 via the port 134. Then, the water in the passage 130 is directed toward the outlet 132 along the water flow.

Thus, the passage within the oil cooler water supply hose 128, one end side of the passage 130 of the fitting member 129, the port 133, and the passage within the oil cooler inlet hose 137, form an inlet passage 143 through which the water from the generator cover 59 is sent to the oil cooler passage 140. 410 is a downstream end of the inlet passage 143. In addition, the passage within the oil cooler outlet hose 138, the port 134, the opposite end side of the passage 130 within the fitting member 129, and the passage within the oil cooler discharge hose 139, form an outlet passage 144 through which the water from the oil cooler passage 140 is sent toward the cylinder head 51. 404 is a downstream end of the outlet passage 144, and 408 is an upstream end of the outlet passage 144. The passage 130 within the fitting member 129 forms a bypass passage 145 to directly connect the inlet passage 143 to the outlet passage 144 between the ports 133 and 134.

The bypass passage 145 serves to limit the amount of water sent to the oil cooler passage 140. So, even in winter season when the temperature of the water outside the watercraft is low, the temperature of the engine oil easily increases. In addition, the bypass passage 145 extends linearly along the water flow from the inlet port 131 to the outlet port 132, and the inlet passage 143 and the outlet passage 144 are formed to bend at a right angle. Such a passage structure makes it easy to limit the amount of water to be supplied to the oil cooler passage 140, making it easier to increase the temperature of the engine oil.

Alternatively, the diameter of the ports 133 and 134 may be set smaller than the diameter of the bypass passage 145 so that the water easily flows in the bypass passage 145. In a further alternative, the structure of the bypass passage 145, the structure of the inlet passage 143 and the structure of the outlet passage 144 are not limited to those described above, but may be suitably changed.

The third water drawing port 84 is coupled to the intercooler 34 via the intercooler water supply hose 150. The water flows out from the third water drawing port 83 and is sent to the intercooler 34 via a passage 151 within the intercooler water supply hose 150. Then, the water is drained outside the watercraft via the passage 95 within the drain hose 94.

In FIG. 5, a bilge system 160, bilge filters 161 in the bilge system 160, joints 162 coupling hoses extending from the bilge filters 161 to the pump nozzle 21 of the water jet pump P are illustrated.

Whereas in the present embodiment, the system is configured to include the valve unit 118 and the bypass passage 145, it may be configured to include at least one of them.

Figure 9:
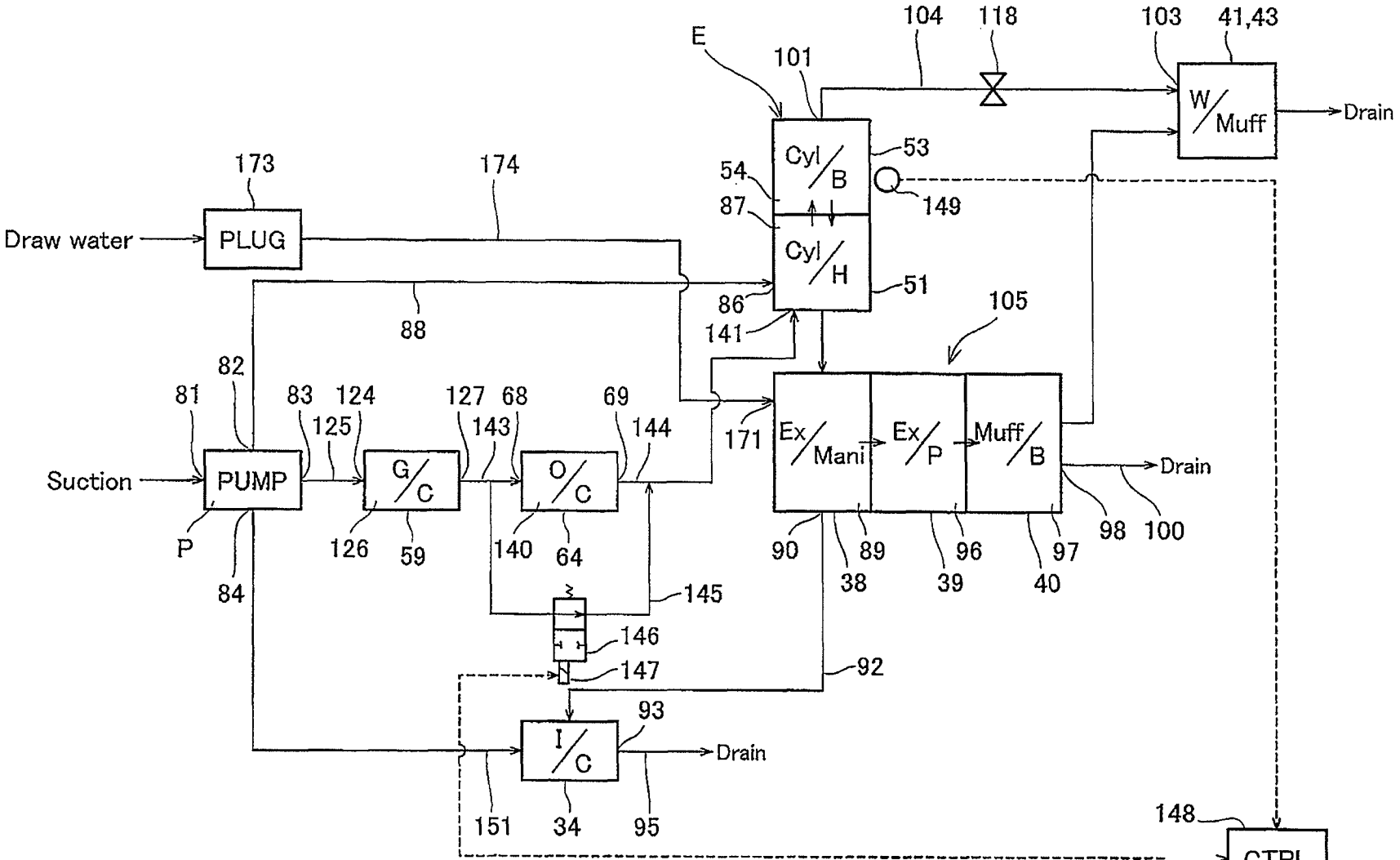
FIG. 9 is a block diagram schematically showing an alternative example of the cooling system of FIG. 4 according to the first embodiment.

FIG. 9 shows an alternative example of the first embodiment. In the cooling system of FIG. 9, a bypass valve unit 146 is provided on the bypass passage 145 and is configured to limit the amount of water flowing in the bypass passage 145. The bypass valve unit 146 may be an electromagnetic on-off valve unit which is configured to operate by excitation of a solenoid 147 as illustrated in the example. A controller 148 is built into the watercraft to control driving of the electromagnetic on-off valve unit. In a normal state, a spool of the bypass valve unit 146 is positioned so as to open the bypass passage 145. The controller 148 is configured to output an electric signal to the solenoid 147 when the temperature of the wall surface of the engine E is a predetermined value or higher, based on a signal received from a temperature sensor 149. Thereby, the bypass passage 145 is closed. In such a configuration, the bypass passage 145 is closed when the temperature of the wall surface of the engine E is higher so that the water from the generator cover 59 is preferentially sent to the oil cooler 140. This effectively inhibits the excessive temperature increase of the engine oil. It should be noted that the bypass valve unit 146 is on-off controlled with reference to other engine states such as the temperature of the water flowing in the downstream passage 104, or the engine speed, instead of with reference to only the wall surface temperature of the engine.

The bypass valve unit 146 is not limited to the illustrated on-off valve unit so long as the bypass valve unit 146 is capable of limiting the amount of water flowing in the bypass passage 145 according to the temperature of the water. For example, the bypass valve unit 146 may be an orifice configured to change a passage cross-sectional area depending on the water temperature.

Figure 10:
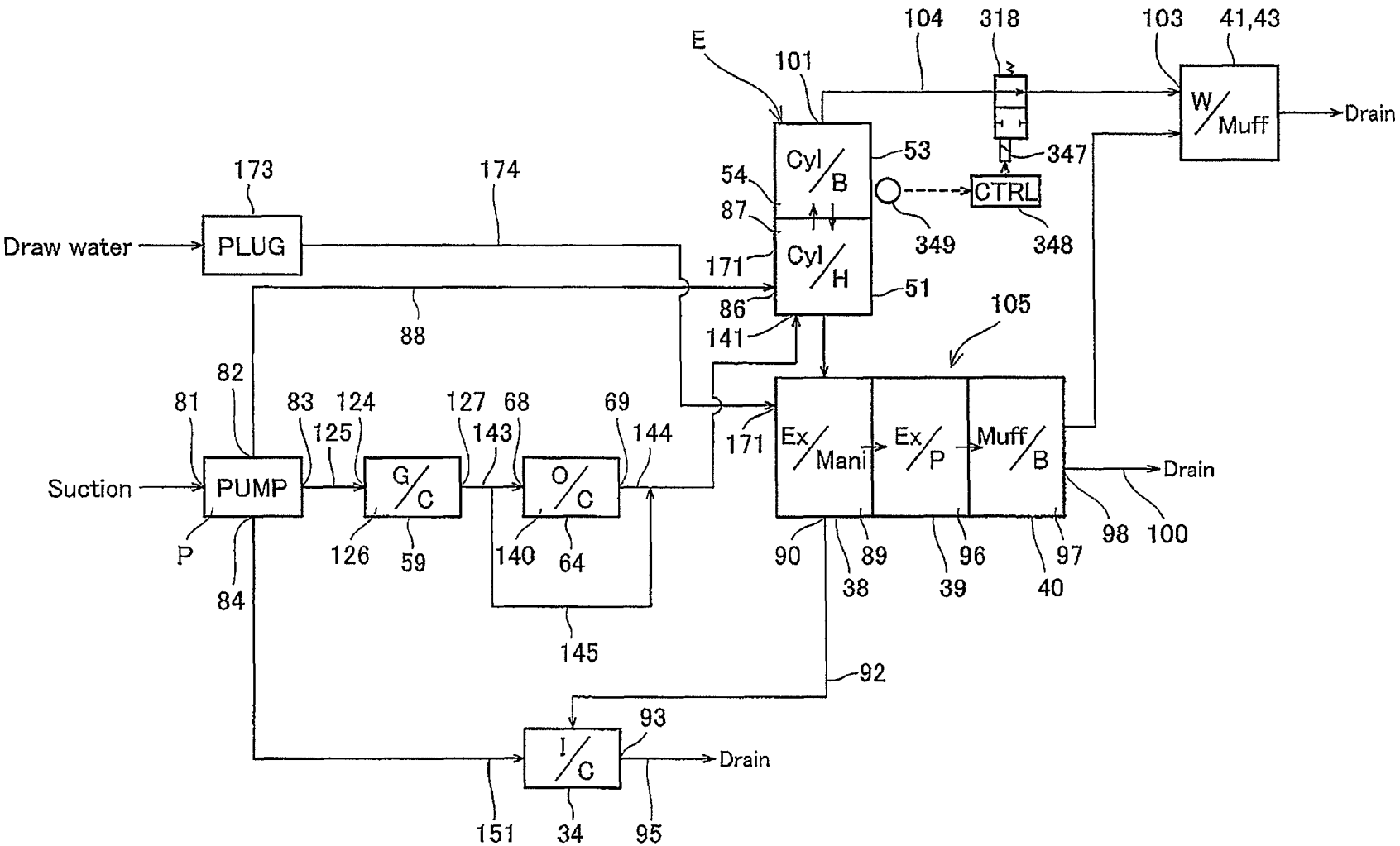
FIG. 10 is a block diagram schematically showing another alternative example of the cooling system of FIG. 4 according to the first embodiment.

FIG. 10 shows another alternative example of the first embodiment. In a cooling system of FIG. 10, an electromagnetic valve unit 318 replaces the valve unit 118 (see FIG. 4) provided in the downstream passage 104. The electromagnetic valve unit 318 is, for example, a normal open type electromagnetic on-off valve unit which is configured to open the downstream passage 104 in a normal state, and to close the downstream passage 104 by excitation of the solenoid 347. To control the electromagnetic valve unit 318, the watercraft includes a controller 348. The controller 348 outputs an electric signal to the solenoid 347 when the temperature of the wall surface of the engine E is lower than a predetermined value, based on a signal received from the temperature sensor 349. In this configuration, the downstream passage 104 is closed when the temperature of the wall surface of the engine E is low, making it easy to increase the temperature of the engine oil. It should be noted that the electromagnetic valve unit 318 is on-off controlled with reference to other engine states such as the temperature of the water flowing in the downstream passage 104, or the engine speed, instead of with reference to only the wall surface temperature of the engine. Furthermore, the electromagnetic valve unit 318 is not limited to the on-off valve so long as it is capable of restricting the amount of the water flowing in the downstream passage 104 based on the temperature of the water. For example, the electromagnetic valve unit 318 may be ones which are configured to change their passage cross-sectional areas based on, for example, a water temperature.

Embodiment 2

Figure 11:
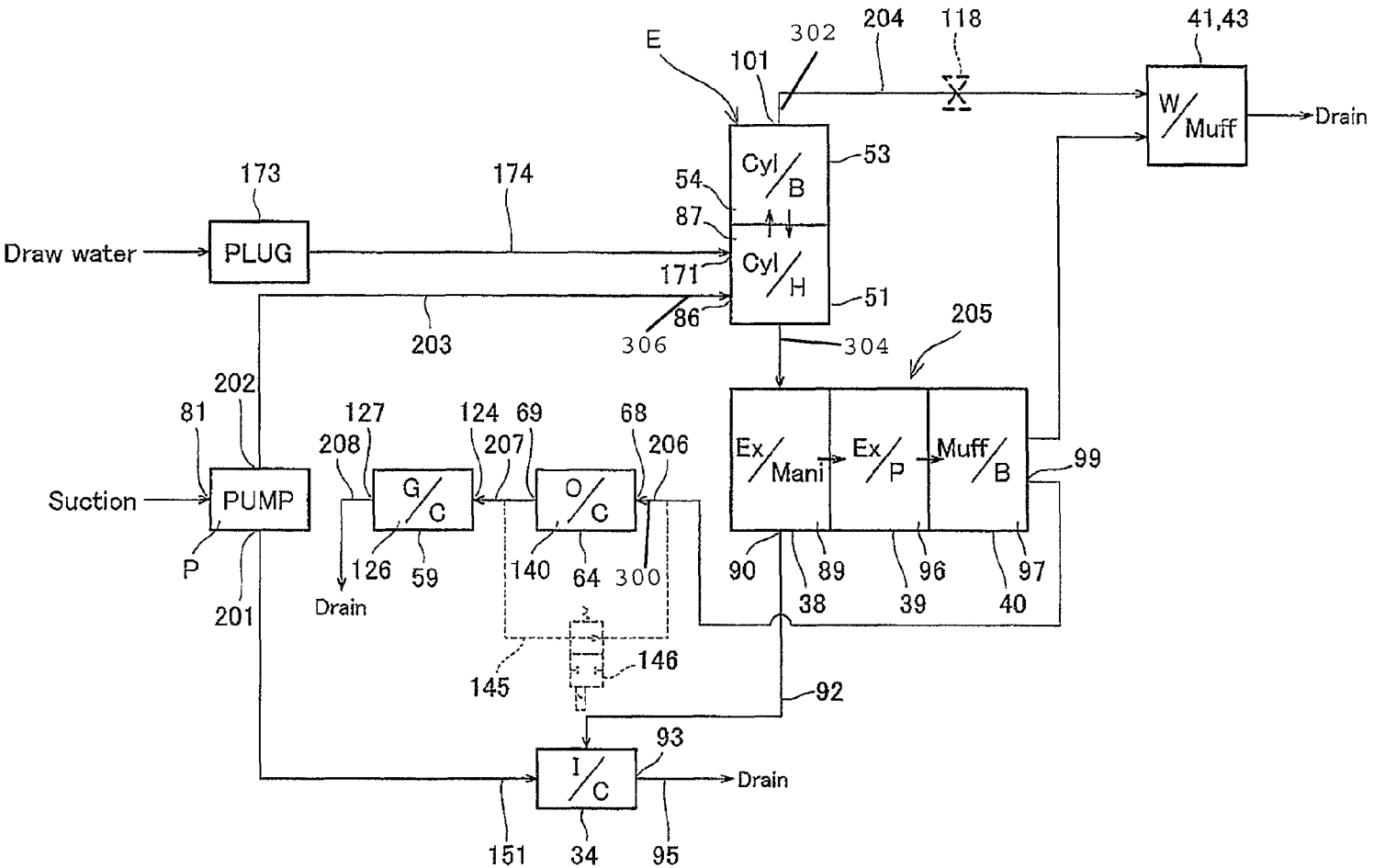
FIG. 11 is a block diagram schematically showing a cooling system according to a second embodiment which is applicable to the personal watercraft of FIG. 1.

FIG. 11 is a block diagram schematically showing a cooling system according to a second embodiment of the present invention which is applicable to the personal watercraft of FIG. 1. As in the first embodiment, the cooling system of the second embodiment is an open-loop water cooling system. In FIG. 10, the same components as those in the first embodiment are identified by the same reference numerals and will not be further described.

Turning to FIG. 10, the pump casing 18 (see FIG. 1) of the water jet pump P is provided with two water drawing ports 201 and 202. The water drawing ports 201 and 202 are positioned rearward relative to the impeller 16 (see FIG. 1) for generating the water flow in the water flow direction.

The first water drawing port 201 is coupled to the intercooler 34 via a passage 151 within an intercooler water supply hose (not shown). The intercooler 34 communicates with outside the watercraft via the passage 95 within a drain hose (not shown). In this structure, the water ejected from the water jet pump P is drained outside the watercraft via the passage 151 within the intercooler water supply hose, the interior of the intercooler 34, and the passage 95 of the drain hose.

The second water drawing port 202 is coupled to a water inlet 86 provided on an outer surface of the cylinder head 51 via an upstream passage 203 formed by an engine water supply hose (not shown). 306 is a downstream end of the upstream passage 203. In this structure, the water ejected from the water jet pump P is sent to the cylinder head passage 87 formed within the cylinder head 51 through the upstream passage 203. The cylinder head passage 87 is connected to the cylinder block passage 54. The passages 87 and 54 form an integral passage within the engine E.

The cylinder block passage 54 is connected to the left water muffler 41 and the right water muffler 43 via a passage formed by a muffler water supply hose (not shown) connected to the outer surface of the cylinder block 53. The water in the water mufflers 41 and 43 are drained outside the watercraft together with the exhaust gas.

The cylinder head passage 87 is connected to the manifold passage 89 formed within the exhaust manifold 38. The manifold passage 89 is connected to an exhaust pipe passage 96 within the exhaust pipe 39. The exhaust pipe passage 96 is connected to a muffler body passage 97 within the muffler body 40. The muffler body passage 97 is connected to the water muffler 41 and 43.

In this structure, a part of the water flowing in the cylinder head passage 87 is drained outside the watercraft via the cylinder block passage 53, and the water muffler 41 and 43, or is sent to the muffler body passage 97 via the manifold passage 89 and the exhaust pipe passage 96. Then, the water is sent to the water mufflers 41 and 43 via the muffler body passage 97. Finally, the water is drained from the water mufflers 41 and 43 outside the watercraft together with the exhaust sent from the cylinder block passage 54.

Thus, the manifold passage 89 connected to the cylinder head passage 87 and a passage located downstream thereof form a downstream passage 205 to which the water from the passage within the engine E flows out, while the passage within the muffler water supply hose 102 which is connected to the cylinder block passage 54 forms a downstream passage 204 to which the water from the passage within the engine E flows out. In brief, the cooling system includes the two downstream passages 204 and 205. 302 is an upstream end of the downstream passage 204, 304 is an upstream end of the downstream passage 205, and 300 is a downstream end of the downstream passage 205.

The muffler body 40 is provided with a water outlet 99 on an outer surface thereof. One end of the oil cooler water supply hose (not shown) is coupled to the water outlet 99. An opposite end of the oil cooler water supply hose is coupled to the inlet port 68 provided on the outer surface of the oil cooler passage 140. One end of the oil cooler water discharge hose (not shown) is coupled to the outlet port 69 of the oil cooler passage 140. An opposite end of the oil cooler water discharge hose is coupled to the water inlet 124 provided on the outer surface of the generator cover 59. The generator cover 59 is provided on the outer surface thereof with the water outlet 127 to which one end of the drain hose is coupled.

In this structure, a part of the water flowing in the muffler body passage 97 is drained outside the watercraft via the passage 206 within the oil cooler water supply hose, the oil cooler passage 140, the passage 207 within the oil cooler water discharge hose, the passage 126 within the generator cover 59, and the passage 208 within the drain hose. In this cooling system, the passage 206 within the oil cooler water supply hose forming the downstream passage 205 is coupled at its downstream end 300 to the inlet port 68 of the oil cooler passage 140.

In the winter season, just after the engine E starts, the temperature of the engine oil is substantially as low as ambient temperature or the temperature of the water outside the watercraft (e.g., 0 to 10 degrees centigrade). On the other hand, the water from the water jet pump P exchanges heat with the wall surface of the engine body of the engine E and the components 38, 39, and 40 in the exhaust system, while flowing in the passage within the engine E and the passages formed in the components 38, 39, and 40. As a result, the temperature of the water to be sent to the oil cooler passage 140 increases up to a value higher than the ambient temperature or the temperature of the water outside the watercraft, for example, 50 to 80 degrees centigrade. Since the temperature of the water flowing in the oil cooler 140 becomes higher than the temperature of the engine oil sent to the oil cooler 64, the temperature of the engine oil increases by heat exchange with the water in the oil coolant passage 140. As a result, even in the winter season, the temperature of the engine oil easily and quickly increases up to a suitable one.

For example, in a case where the amount of the rider's operation of the throttle lever is maximum so that the throttle valve (not shown) is fully opened, and therefore the engine speed is high, the temperature of the engine oil is higher than 100 degrees centigrade, e.g., 120 to 160 degree centigrade. On the other hand, the water from the water jet pump P exchanges heat with the wall surface of the engine body of the engine E and the components 38, 39, and 40 in the exhaust system while flowing in the passage within the engine E and the passages formed in the components 38, 39, and 40, but its temperature does not exceed 100 degrees centigrade, and is 70 to 80 degrees centigrade, because the water outside the watercraft is used as the coolant. Since the temperature of the water flowing in the oil cooler passage 140 is lower than the temperature of the engine oil sent to the oil cooler 64, the temperature of the engine oil decreases, because of the heat exchange between the engine oil and the water. Thus, if the engine speed is high, the engine oil is cooled to have a suitable temperature.

On the other hand, in a case where the amount of the rider's operation of the throttle lever is minimum so that the throttle valve is fully closed, and therefore the engine speed is low, the engine oil sent to the oil cooler 64 can be warmed by using the water flowing in the oil passage 140 as in the situation just after start of the engine E.

As should be appreciated from the above, in the cooling system of the present embodiment, the water from the water jet pump P flows in the passage within the engine E and the passages formed in the exhaust system, and is thereafter sent to the oil cooler passage 140. In this configuration, just after start of the engine E, the oil cooler 64 serves as an oil warmer to facilitate increasing of the temperature of the engine oil. That is, in a case where the engine speed tends to be high and therefore the temperature of the engine oil tends to be high, the oil cooler 64 serves as a typical oil cooler for cooling the engine oil, while in a case where the engine speed tends to be low and therefore the temperature of the engine oil tends to be low, the oil cooler 64 serves as the oil warmer. That is, the oil cooler 64 serves as an engine oil temperature control device depending on the engine speed of the engine E. Thus, the engine oil is controlled to have a suitable temperature depending on a state of the engine E.

Whereas the cylinder block passage 54 is connected to the water mufflers 41 and 43 all the time in the second embodiment, the valve unit 118 may be selectively provided in the downstream passage 204 between the cylinder block passage 54 and the water mufflers 41 and 43 as in the first embodiment.

As in the first embodiment, the bypass passage 145 may be selectively provided to directly couple the passage 206 coupled to the inlet port 68 of the oil cooler passage 140 and the passage 207 coupled to the outlet port 69 of the oil cooler passage 140. Furthermore, as in the alternative example of the first embodiment, a bypass valve unit 146 may be selectively provided on the bypass passage 145 to restrict the amount of water flowing in the bypass passage 145.

Whereas the open-loop water cooling system is illustrated as the cooling system of the first and second embodiments, the present invention may be applicable to a water cooling system in which the coolant passages form a closed-loop. In that case, as the water flow generator, a circulating pump operable in association with the engine E may be provided in the coolant passage.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A personal watercraft comprising:

an engine mounted in a body of the watercraft;

an open-loop water cooling system in which water from outside the watercraft is suctioned as a coolant, flows in a coolant passage, and is drained outside the watercraft;

a water flow generator driven by the engine to generate a water flow in the coolant passage; and a valve unit for restricting a flow of the water in the coolant passage;

wherein the coolant passage includes an upstream passage located upstream of the engine in a water flow direction and a downstream passage located downstream of the engine; and wherein the downstream passage is coupled at its downstream end to an oil cooler passage in which the water exchanges heat with an engine oil sent to an oil cooler for controlling a temperature of the engine oil.

2. A personal watercraft comprising:

an engine mounted in a body of the watercraft;

an open-loop water cooling system in which water from outside the watercraft is suctioned as a coolant, flows in a coolant passage, and is drained outside the watercraft;

a water flow generator driven by the engine to generate a water flow in the coolant passage; and a valve unit for restricting a flow of the water in the coolant passage;

wherein the coolant passage includes an upstream passage located upstream of the engine in a water flow direction and a plurality of downstream passages located downstream of the engine;

wherein the valve unit opens and closes one of the plurality of downstream passages;

wherein the downstream passage which is provided with the valve unit is coupled at its upstream end to a cylinder block passage provided in a cylinder block of the engine;

wherein the upstream passage is coupled at its downstream end to a cylinder head passage provided in a cylinder head of the engine, and the downstream passage which is not provided with the valve unit is coupled at its upstream end to the cylinder head passage; and wherein the cylinder block passage and the cylinder head passage are connected to each other.

3. A personal watercraft comprising:

an engine mounted in a body of the watercraft;

an open-loop water cooling system in which water from outside the watercraft is suctioned as a coolant, flows in a coolant passage, and is drained outside the watercraft;

a water flow generator driven by the engine to generate a water flow in the coolant passage; and a valve unit for restricting a flow of the water in the coolant passage;

wherein the valve unit includes a valve bore formed in the coolant passage, a valve plug accommodated in the valve bore; and a downstream seat portion which is located on a downstream side of the valve bore, for seating the valve plug thereon; and wherein the valve plug is seated on the downstream seat portion to close a passage in the valve bore when a flow rate of the water flowing in the coolant passage is a predetermined value or larger, and is away from the downstream seat portion when the flow rate of the water flowing in the coolant passage is smaller than the predetermined value.

4. The personal watercraft according to claim 3, wherein the valve unit includes an upstream seat portion which is located on an upstream side of the valve bore, for seating the valve plug thereon when a pressure of the water flowing in the coolant passage is smaller than a predetermined value; and wherein the upstream seat portion is provided with a connecting portion which permits the water to flow in the valve bore with the valve plug seated on the upstream seat portion.

5. The personal watercraft according to claim 4, wherein the valve plug drops by a gravitational force to be seated on the upstream seat portion.

6. The personal watercraft according to claim 4, wherein the valve plug is subjected to a force applied from a biasing member disposed within the valve bore to be seated on the upstream seat portion.

7. A personal watercraft comprising:

an engine mounted in a body of the watercraft;

an open-loop water cooling system in which water from outside the watercraft is suctioned as a coolant, flows in a coolant passage, and is drained outside the watercraft;

a water flow generator driven by the engine to generate a water flow in the coolant passage; and a valve unit for restricting a flow of the water in the coolant passage;

wherein the coolant passage includes an oil cooler passage in which the water exchanges heat with an engine oil sent to an oil cooler for controlling a temperature of the engine oil;

an inlet passage coupled at its downstream end to an inlet port of the oil cooler passage;

an outlet passage coupled at its upstream end to an outlet port of the oil cooler passage; and a bypass passage for directly coupling the inlet passage to the outlet passage.

8. A personal watercraft comprising:

an engine mounted in a body of the watercraft;

an open-loop water cooling system in which water from outside the watercraft is suctioned as a coolant, flows in a coolant passage, and is drained outside the watercraft; and a water flow generator driven by the engine to generate a water flow in the coolant passage;

wherein the coolant passage includes:

an oil cooler passage in which the water exchanges heat with an engine oil sent to an oil cooler for controlling a temperature of the engine oil;

an inlet passage coupled at its downstream end to an inlet port of the oil cooler passage;

an outlet passage coupled at its upstream end to an outlet port of the oil cooler passage; and a bypass passage for directly coupling the inlet passage to the outlet passage.

9. The personal watercraft according to claim 8, further comprising:

a bypass valve unit for restricting a flow of water flowing in the bypass passage.

10. The personal watercraft according to claim 9, further comprising:

an actuator for driving the bypass valve unit; and a controller for controlling the actuator;

wherein the controller controls the actuator according to a temperature of the water flowing in the coolant passage.

11. A personal watercraft comprising:

an engine mounted in a body of the watercraft;

an open-loop water cooling system in which water from outside the watercraft is suctioned as a coolant, flows in a coolant passage, and is drained outside the watercraft; and a water flow generator driven by the engine to generate a water flow in the coolant passage;

wherein the coolant passage includes an upstream passage located upstream of the engine in a water flow direction and a downstream passage located downstream of the engine; and wherein the downstream passage is coupled at its downstream end to an oil cooler passage in which the water exchanges heat with an engine oil sent to an oil cooler for controlling a temperature of the engine oil.

12. The personal watercraft according to claim 11, wherein a temperature of the water flowing into the oil cooler passage is higher than the temperature of the engine oil within the oil cooler when an engine speed of the engine is low; and wherein the temperature of the water flowing into the oil cooler passage is lower than the temperature of the engine oil within the oil cooler when the engine speed of the engine is high.

* * * * *